US008005414B2

(12) United States Patent
Hasegawa

(10) Patent No.: US 8,005,414 B2
(45) Date of Patent: Aug. 23, 2011

(54) IMAGE HEATING APPARATUS

(75) Inventor: Mitsuru Hasegawa, Kashiwa (JP)

(73) Assignee: Canon Kabushiki KAisha, Tokyo (JP)

( * ) Notice: Subject to any disclaimer, the term of this patent is extended or adjusted under 35 U.S.C. 154(b) by 0 days.

(21) Appl. No.: 12/702,401

(22) Filed: Feb. 9, 2010

(65) Prior Publication Data

US 2010/0202810 A1 Aug. 12, 2010

(30) Foreign Application Priority Data

Feb. 9, 2009 (JP) ..... 2009-027784

(51) Int. Cl.
*G03G 15/20* (2006.01)

(52) U.S. Cl. ..... 399/331; 219/216

(58) Field of Classification Search ..... 399/122, 399/320, 328, 329, 331; 219/216, 244
See application file for complete search history.

(56) References Cited

U.S. PATENT DOCUMENTS 5,210,579 A 5/1993 Setoriyama et al.
5,525,775 A 6/1996 Setoriyama et al.
2005/0185996 A1* 8/2005 Oishi et al. ..... 399/329
2006/0198671 A1* 9/2006 Kawahata ..... 399/329
2007/0278203 A1* 12/2007 Creteau et al. ..... 219/216

FOREIGN PATENT DOCUMENTS

JP 2-157878 6/1990
JP 4-044075 2/1992
JP 4-204980 7/1992

* cited by examiner

*Primary Examiner* — David P Porta
*Assistant Examiner* — Benjamin Schmitt
(74) *Attorney, Agent, or Firm* — Fitzpatrick, Cella, Harper & Scinto

(57) ABSTRACT

An image bearing apparatus includes an image heating belt heating a toner image on a sheet in a nip; a roller, opposing the belt, and forming the nip between the belt and itself; a pad, sandwiching the belt between the roller and itself, and pressing the belt toward the roller in the nip; a device pressing at least one of the pad and the roller so that the belt is pressed between the pad and the roller in the nip; and a device changing a pressure in the nip by the pressing device. The pad has a thickness, at its longitudinal central portion, larger than that at its longitudinal end portions. The pad has two curved surfaces, each being curved toward the opposing roller so that the longitudinal central portion of the pad is closer to the opposing roller than the longitudinal end portions of the pad.

5 Claims, 8 Drawing Sheets

IMAGE HEATING APPARATUS

FIELD OF THE INVENTION AND RELATED ART

The present invention relates to an image heating apparatus used in an image forming apparatus of an electrophotographic type such as a copying machine, a printer, or a facsimile machine.

The image forming apparatus in which a toner image is transferred onto a recording material and then the recording material is nip-conveyed and heat-pressed in a heating nip of the image heating apparatus to fix a full-color or monochromatic image on the recording material has been used widely. The image heating apparatus is used for not only fixing an unfixed toner image on the recording material but also adjusting a finishing state of an image surface by heat-pressing the recording material on which a partly or completely fixed toner image is carried.

Japanese Laid-Open Patent Application (JP-A) Hei 2-157878 discloses an image heating apparatus in which a heating nip for the recording material is formed by pressing a nip forming member, including a shaft member and an elastic layer provided outside the shaft member, against an endless belt supported by a heating member at an inner surface of the belt. In the image heating apparatus, the belt has small heat capacity and thus a temperature in the heating nip is increased early, so that there is no need to supply electric power during stand-by. Therefore, compared with a roller heating type, the image heating apparatus is capable of suppressing total electric power consumption at a low level.

JP-A Hei 4-44075 discloses a similar image heating apparatus in which the recording material heating nip is formed by the belt and the nip-forming member. In this image heating apparatus, the heating member provided with a heater at its surface rubs the inner surface of the belt, and a pressing member which penetrates the belt and is disposed in a beam configuration uniformly presses the rear surface of the heating member toward the nip-forming member with respect to a longitudinal direction.

JP-A Hei 4-204980 discloses a similar image heating apparatus in which the recording material heating nip is formed by the belt and the nip-forming member. In this image heating apparatus, a pressing force in the heating nip is adjusted by a pressing mechanism for changing an urging state at end portions of the nip-forming member and end portions of the pressing member.

As shown in FIG. 2, in the image heating apparatus in which the heating nip for a recording material P is formed by a belt 1 supported by a pressing member 5 and a heating member 4 and by a nip-forming member 2, it is desired that a mechanism is reduced in size, weight, cost and space. For this reason, with a decreasing diameter of the belt, a cross-sectional area of the pressing member 5 and the heating member 4 is insufficient, thus resulting in an elongated shape. As a result, the pressing member 5 and the heating member 4 have insufficient rigidity (flexing resistance), thus being liable to be curved. Further, a shaft member 3 of the nip-forming member 2 is reduced in diameter and is formed in a pipe shape, so that the shaft member 3 of the nip-forming member 2 also has insufficient rigidity (flexing resistance), thus being liable to be curved.

For this reason, as shown in FIG. 3, when the nip-forming member 2 and the pressing member 5 are supported at respective end portions and are urged against each other under pressure with respect to a press-contact direction, the nip-forming member 2 and the pressing member 5 are curved outwardly (convexly), so that partial pressure lowering in the nip at central portions of these members is caused to occur with respect to a longitudinal direction as shown in FIG. 5.

For this reason, as shown in FIG. 8, the heating member 4 is formed in a large thickness at its longitudinal central portion with respect to a pressing direction correspondingly to an amount of b of the nip-forming member 2 and the pressing member, so that the nip pressure in the heating nip with respect to the longitudinal direction is uniformized in a state in which the nip-forming member 2 and the pressing member 5 are outwardly curved.

Incidentally, in recent years, the number of the type of recording materials subjected to image formation is increased, so that the pressing force in the heating nip of the image heating apparatus has been required to be switched at a plurality of levels. In the case of thick paper or gloss coated paper, the amount of heat adsorbed by the recording material is large, so that in order to ensure the heat amount necessary to fix the toner image, the pressing force may preferably be increased to increase a length of the heating nip with respect to a rotational direction. Further, in the case of thin paper, the pressing force may preferably be lowered in order to prevent crease of the recording material.

However, as shown in FIG. 9, when the pressing force in the heating nip is lowered by decreasing the urging force at the end portions of the nip-forming member 2 and the pressing member, the partial pressure lowering is caused to occur at the longitudinal end portions in the heating nip in which a distribution of nip pressure has been uniform before the lowering in pressing force. This is because when the pressing force in the heating nip is lowered, the curve amount of the nip-forming member 2 and the pressing member 5 is decreased and an increased amount of the thickness provided to the longitudinal central portion of the heating member 4 on the assumption that the pressing force is increased, so that the pressure concentrates at the central portion.

SUMMARY OF THE INVENTION

A principal object of the present invention is to provide an image heating apparatus which is less liable to cause a partial pressure lowering in a nip with respect to a longitudinal direction when the pressure in the nip is changed.

According to an aspect of the present invention, there is provided an image bearing apparatus comprising:

an image heating belt configured and positioned to heat a toner image on a sheet in a nip;

an opposing roller, disposed opposed to the image heating belt, configured to form the nip between the image heating belt and itself;

a pad, disposed so as to sandwich the image heating belt between the opposing roller and itself, configured to press the image heating belt toward the opposing roller in the nip;

a pressure device configured and positioned to press at least one of the pad and the opposing roller so that the image heating belt is pressed between the pad and the opposing roller in the nip;

a pressure changing device configured and positioned to change a pressure in the nip by the pressing device;

wherein the pad has a thickness, at its longitudinal central portion, larger than that at its longitudinal end portions, and wherein the pad has two curved surfaces, each of the two curved surfaces being curved toward the opposing roller so that the longitudinal central portion of the pad is closer to the opposing roller than the longitudinal end portions of the pad.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, with reference to the drawings, embodiments of the present invention will be described. The present invention can also be carried out in other embodiments in which a part or all of constitutions in the embodiments are replaced with their alternative constitutions so long as a gap with respect to a pressing direction is created at a central portion of a heating member under no pressure.

Therefore, the present invention is applicable to not only an image heating apparatus in which a pressing roller press-contacts a belt but also an image heating apparatus in which a pressing belt press-contacts a belt. The image heating apparatus includes not only a fixing device (apparatus) for fixing a toner image on a recording material but also a surface treating (processing) device for heat-pressing a fixed image or a semi-fixed image.

An image forming apparatus in which the image heating apparatus is to be mounted is not limited to the image forming apparatus using an intermediary transfer belt but may also be the image forming apparatus using a recording material conveyer belt and the image forming apparatus for transferring the toner image onto the recording material in a sheet-feeding manner. Further, the type of the image forming apparatus is not limited to a tandem type in which a plurality of photosensitive drums but also a one-drum type in which a single photosensitive drum is disposed along the belt.

In this embodiment, a principal portion relating to toner image formation/transfer will be described but can also be carried out in various fields of uses such as a printer, various printing machines, a copying machine, a facsimile machine, and a multi-function machine by adding necessary equipment, device and casing structure.

<Image Forming Apparatus>

Figure 1:
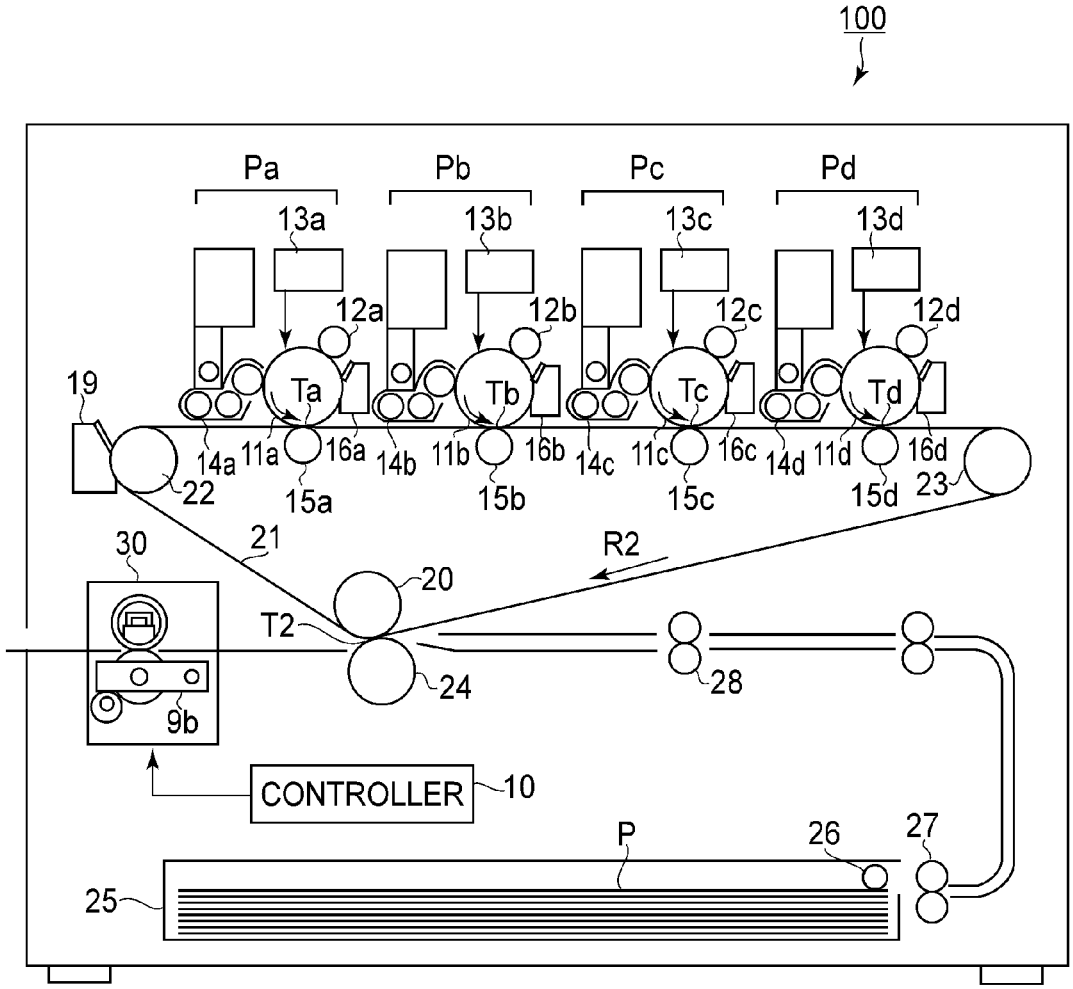
FIG. 1 is an explanatory view of a constitution of an image forming apparatus.

FIG. 1 is an explanatory view of a constitution of the image forming apparatus.

As shown in FIG. 1, the image forming apparatus 100 is a tandem type full-color printer in which image forming portions Pa, Pb, Pc and Pd different in color for development are disposed along an intermediary transfer belt 21.

At the image forming portion Pa, a yellow toner image is formed on a photosensitive drum 11*a* and is primary-transferred onto the intermediary transfer belt 21. At the image forming portion Pb, a magenta toner image is formed on a photosensitive drum 11*b* and is primary-transferred onto the yellow toner image on the intermediary transfer belt 21. At the image forming portions Pc and Pd, a cyan toner image and a black toner image are formed on photosensitive drums Pc and Pd, respectively, and is similarly primary-transferred successively onto the toner images on the intermediary transfer belt 21.

The four color toner images carried on the intermediary transfer belt 21 are collectively secondary-transferred onto the recording material P at a secondary transfer portion T2. The recording material P onto which the toner images are secondary-transferred at the secondary transfer portion T2 is heat-pressed by a fixing device (apparatus) 30 and the toner images are fixed on a surface of the recording material P. Thereafter, the recording material P is discharged to the outside of the apparatus.

The recording material P which has been fed one by one from a cassette 25 waits at a position of registration rollers 28 and then is sent to the secondary transfer portion T2 while being timed to the toner images on the intermediary transfer belt 21.

The image forming portions Pa, Pb, Pc and Pd have the substantially same constitution except that the colors of toners used in associated ones of developing devices are different from each other, i.e., are yellow, magenta, cyan and black, respectively. In the following, the image forming portion Pa will be described and with respect to other image forming portions Pb, Pc and Pd, a suffix a of reference numerals (symbols) for representing constituent members (means) for the image forming portion Pa is to be read as b, c and d, respectively, for explanation of associated ones of the constituent members.

At the image forming portion Pa, around the photosensitive drum 11*a*, a charging roller 12*a*, an exposure device 13*a*, a developing device, and a primary transfer roller 15*a* are disposed.

The photosensitive drum 11*a* is constituted by a metal cylinder having a surface at which a photosensitive layer having a negative charge polarity, and is rotated in a direction of an indicated arrow at a predetermined process speed.

The charging roller 12*a* is supplied with an oscillating voltage in the form of a DC voltage biased with an AC voltage to electrically charge the surface of the photosensitive drum 11*a* to a uniform negative potential.

The exposure device 13*a* scans the charged surface of the photosensitive drum 11*a* through a polygonal mirror with a laser beam obtained by ON-OFF modulation of scanning line image data developed from image data, thus writing (forming) an electrostatic image for an image to be formed.

The developing device 14*a* includes a developing sleeve on which negative charged toner is carried and which rubs the photosensitive drum 11. To the developing sleeve, an oscillating voltage in the form of a negative DC voltage biased with an AC voltage is applied, so that the electrostatic image on the photosensitive drum 11*a* is reversely developed.

The primary transfer roller 15*a* press-contacts the intermediary transfer belt 21 against the photosensitive drum 11*a* to form a primary transfer portion Ta between the photosensitive drum 11*a* and the intermediary transfer belt 21. By applying a positive DC voltage to the primary transfer roller 15*a*, the toner image which is negatively charged and carried on the photosensitive drum 11*a* is primary-transferred onto the intermediary transfer belt 21.

A secondary transfer roller 24 press-contacts the intermediary transfer belt 21 against an opposite roller 20 to form the secondary transfer portion T2 between the intermediary transfer belt 21 and the secondary transfer roller 24. At the secondary transfer portion T2, the recording material P is nip-conveyed while being superposed on the intermediary transfer belt 21 on which the toner images are carried. By applying a positive DC voltage to the secondary transfer roller 24, the toner images are secondary-transferred from the intermediary transfer belt 21 onto the recording material P.

<Fixing Device>

Figure 2:
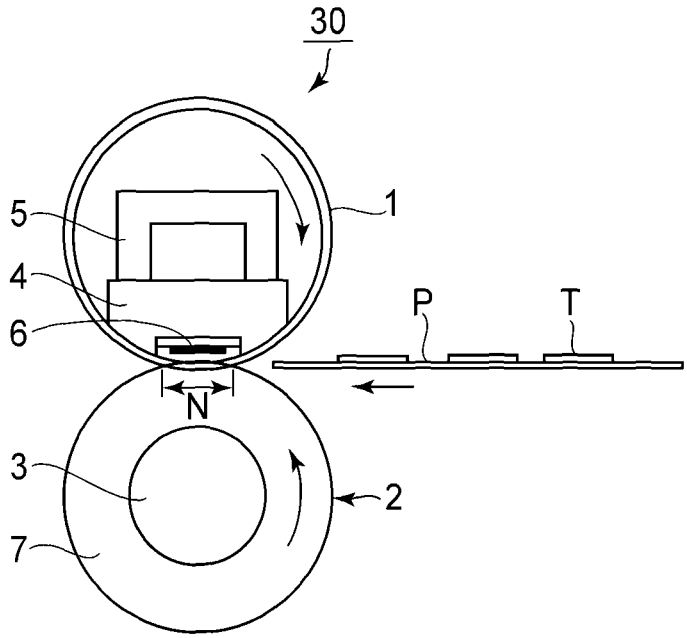
FIG. 2 is an explanatory view of a constitution of a fixing device (apparatus).
Figure 3:
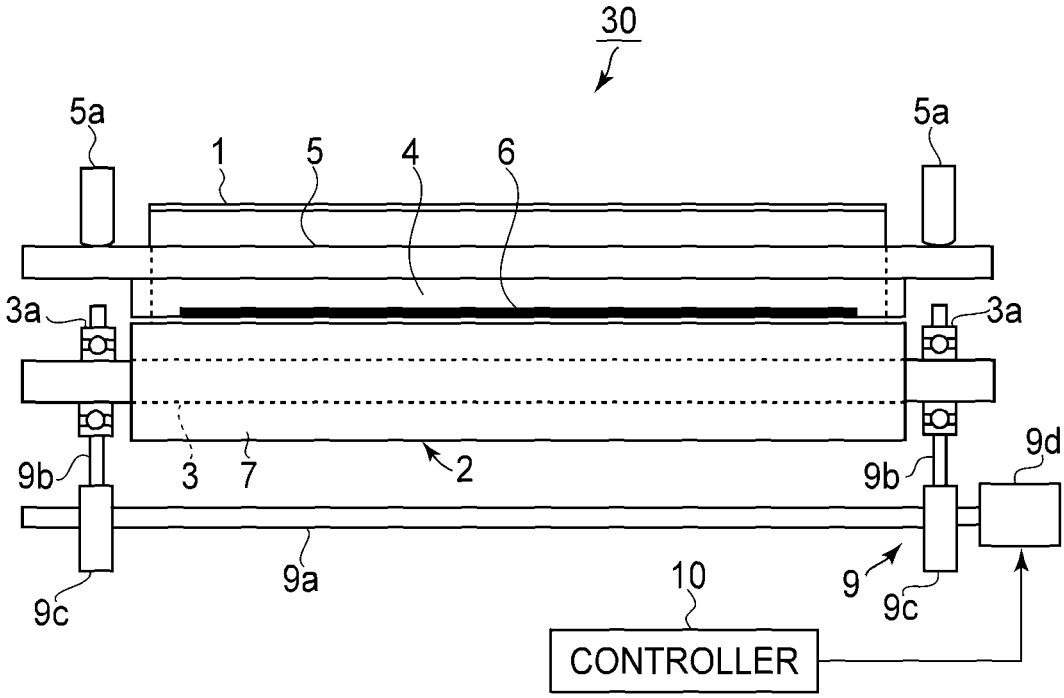
FIG. 3 is an explanatory view of a pressing mechanism of the fixing device.
Figure 4:
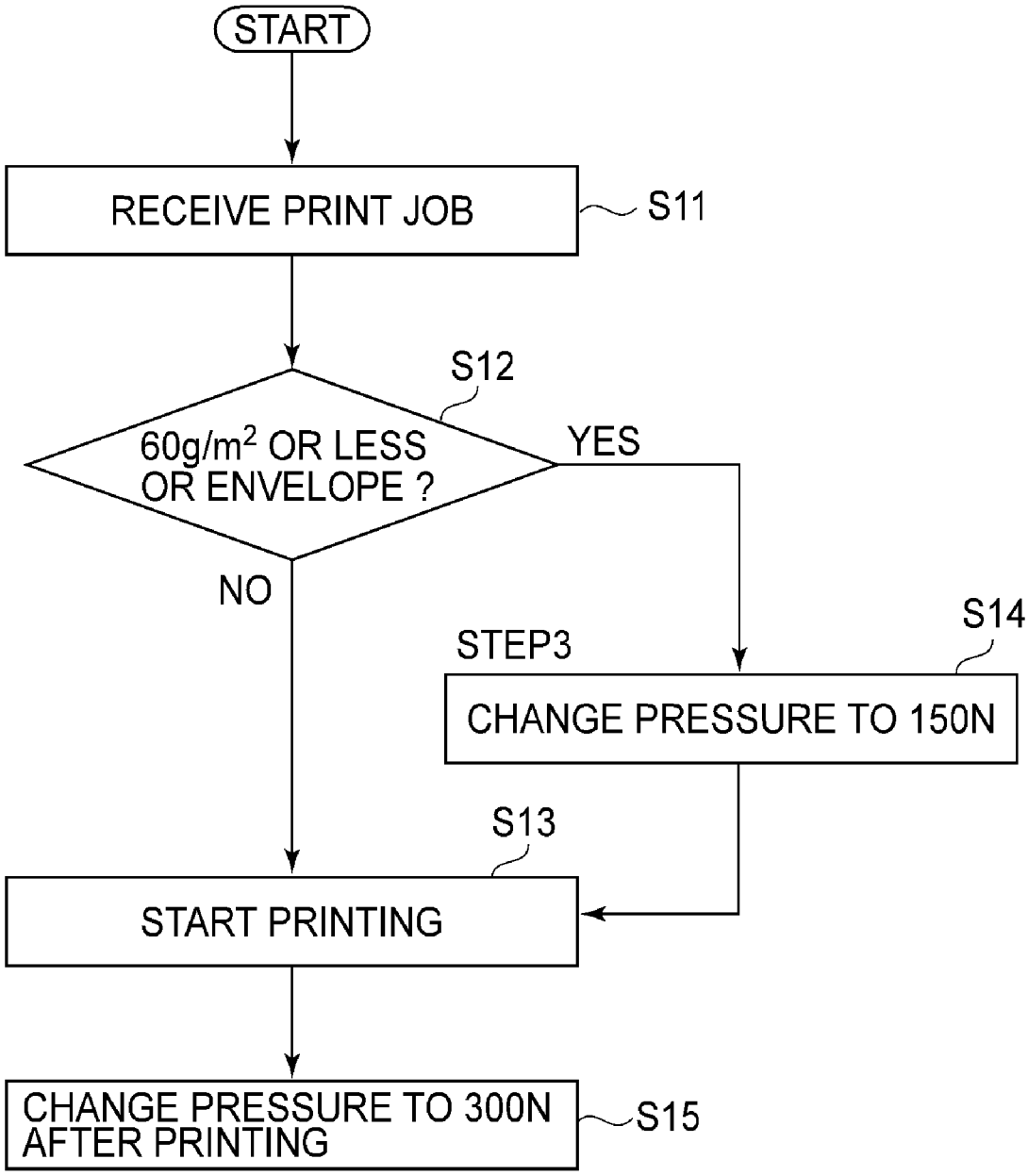
FIG. 4 is a flow chart of pressing force control.

FIG. 2 is an explanatory view of a constitution of the fixing device, FIG. 3 is an explanatory view of a pressing mechanism of the fixing device, and FIG. 4 is a flow chart of pressing force control.

As shown in FIG. 2, the fixing device (apparatus) 30 as the image heating apparatus includes a heating member as a pad, a pressing member 5 as a pressing device, a fixing belt 1 as an image heating belt, and a pressing roller 2 as an opposing roller.

The fixing belt 1 is nipped between the heating member 4 and the pressing roller 2 in a heating member N as a nip in which the toner images formed on the recording material P are to be heated and pressed. Further, the heating member 4 is held by the pressing member 5 as a holder and is fixed at a position with respect to a press-contact direction.

Further, in a process in which the recording material P passes through the heating member N, heat is supplied from a heater 6 as a heat generating element to the recording material P through the fixing belt 1, so that unfixed toner image T is heat-melted and fixed on the surface of the recording material P.

The fixing belt 1 as an example of an endless belt is rotated in contact with an image surface of the recording material P. Specifically, the fixing belt 1 is rotated by the rotation of the pressing roller 2 at the substantially same peripheral speed as a conveying speed of the recording material P, carrying thereon the unfixed toner image T, being conveyed while closely contacting and sliding on a heating surface at which the heater 6 is disposed.

The fixing belt 1 is prepared in an endless shape having an inner diameter of 25 mm by forming an elastic layer of a rubber material having high thermal conductivity on a metal layer high thermal conductivity and high tensile strength and then by forming a surface parting layer of a fluorine-containing resin material.

The metal layer is formed of a stainless steel material in a thickness of 50 μm. The elastic layer is formed of a silicone rubber having the thermal conductivity of 1.0 W/m.K. The parting layer is a 30 μm-thick PFA tube.

The pressing roller 2 as a nip-forming member is prepared by forming an elastic layer 7 of a soft rubber material on an outer surface of a shaft member 3 of a cylindrical material such as iron or aluminum. The pressing roller 2 is formed by coating the surface of the elastic layer 7 with the parting layer of the PFA tube to have an outer diameter of 25 mm.

The shaft member 3 is prepared by using an aluminum pipe having an outer diameter of 10 mm and a thickness of 3 mm. The elastic layer 7 has a thickness of 3 mm and is formed of the silicone rubber material having an ASKER hardness of 64°. The PFA tube has a thickness of 50 μm.

The pressing member 5 is formed in a beam configuration by using a steel material having a U-shaped cross section with 10 mm in width, 10 mm in height, and 2.3 mm in thickness.

The heating member 4 is formed in the beam configuration by using a synthetic resin material such as a liquid crystal polymer which has high heat resistance, high elasticity coefficient, low friction coefficient, and low thermal conductivity, and rubs the inner surface of the fixing belt 1 in a state in which the heating member 4 is extended in a longitudinal direction of the fixing belt 1. The heating member 4 has a recessed portion, on the pressing roller 2 side, at which the heater 6 is embedded and is surface-sealed with a glass material. The heating member 4 is constituted by integrally forming the heater 6 and a supporting member for the heater 6.

The heater 6 includes a heat generating resistor as a heat generating source which generates a heat by electric power supply and is increased in temperature by the heat generation of the heat generating resistor. The heat generating resistor of the heater 6 is formed by printing and sintering Ag/Pd paste on an $Al_2O_3$ substrate in a large thickness.

A temperature detecting sensor (not shown) is disposed in contact with a rear surface of the heater 6, and a temperature-adjusting circuit (not shown) effects ON-OFF control of electric power supplied to the heater 6 so that an output of the temperature detecting sensor approaches a set value. As a result, the surface temperature of the fixing belt 1 is kept in a predetermined temperature range.

During printing on a plurality of sheets, the temperature control of the fixing belt 1 is continued until a series of printing operations is completed. When a final recording material P passes through the heating nip N and is separated and discharged from the fixing belt 1, the rotational drive of the pressing roller 2 is stopped and at the same time, energization to the heater 6 is also stopped.

Incidentally, the fixing belt 1 has a longitudinal length of 340 mm and the heater 6 has the longitudinal length of 370 mm. The heating member 4 has the longitudinal length of 374 mm and the pressing roller 2 has the longitudinal length of 330 mm.

As shown in FIG. 3, the pressing roller 2 is upwardly pressed at its end portions by a pressing mechanism 9 to press-contact the fixing belt 1 supported at the inner surface by the heating member 4, so that the elastic layer 7 is deformed to form the heating nip N in a continuous state with respect to the rotational direction shown in FIG. 2.

The pressing member 5 is supported as an H-beam structure (beam structure supported at end portions) by a frame 5*a* of the fixing device 30 and urges the heating member 4 toward the pressing roller 2 to form the heating nip N between the fixing belt 1 and the pressing roller 2.

The pressing roller 2 is rotatably supported in an H-beam manner by bearings 3*a* at end portions of the shaft member 3. The bearing 3*a* is fixed to a rotatable arm 9*b* (FIG. 1) with a rotatable end which is rotated with respect to the frame 5*a* of the fixing device 30 to be movable upward and downward.

The pressing mechanism 9 changes an urging state of the end portions of the nip-forming member and the pressing member so as to change a pressing force in the heating nip.

The pressing mechanism 9 rotates a cam shaft 9*a* by actuating a driving motor 9*d* to rotate a pair of pressing cams 9*c* as an example of a pressure changing device (means), thus moving the rotatable end upward and downward. As a result, the pressing roller 2 supported by the bearings 3*a* is moved upward and downward to change the pressing force with respect to the fixing belt 1. Incidentally, the pressing mechanism 9 is actually constituted so as to move the rotatable arm 9*b* upward and downward through pressing springs (not shown) by the pressing cams 9*c* as the example of the pressure changing means.

As shown in FIG. 4 with reference to FIG. 3, a control portion 10 controls the driving motor 9*d* when it receives a print job (S11), thus setting a pressing force in the heating nip depending on the type of the recording material. The control portion 10 discriminates the type of the recording material designated on the basis of data of the print job.

In the case where thick paper having large amount of heat absorption is subjected to a fixing process (NO of S12), the control portion 10 starts image formation (S13) while keeping the urging force to be applied to the end portions of the pressing roller 2 at a total pressure of 300N(S15 in a previous print job). As a result, the pressing force in the heating nip N is increased and a length (width) of the heating nip N with respect to the rotational direction is increased, so that temperature and supply heat amount enough to heat-melt the toner image can be ensured.

In the case where thin paper or envelope which is liable to cause crease of the recording material (YES of S12), the control portion 10 lowers the urging force to be applied to the pressing roller 2 to the total pressure of 150N(S14). As a result, the pressing force in the heating member N is lowered and the length of the heating nip N with respect to the rotational direction is decreased, so that the crease of the recording material is less liable to occur.

Comparative Embodiment 1

Figure 5:
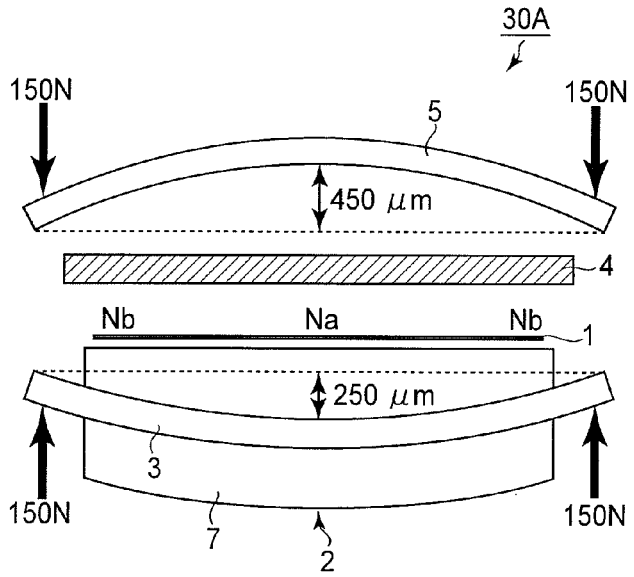
PRIOR ART FIG.5
FIG. 5 is an explanatory view of a curved state of members in the case where a total pressure of 300 N is applied to a fixing device in Comparative Embodiment 1.
Figure 6:
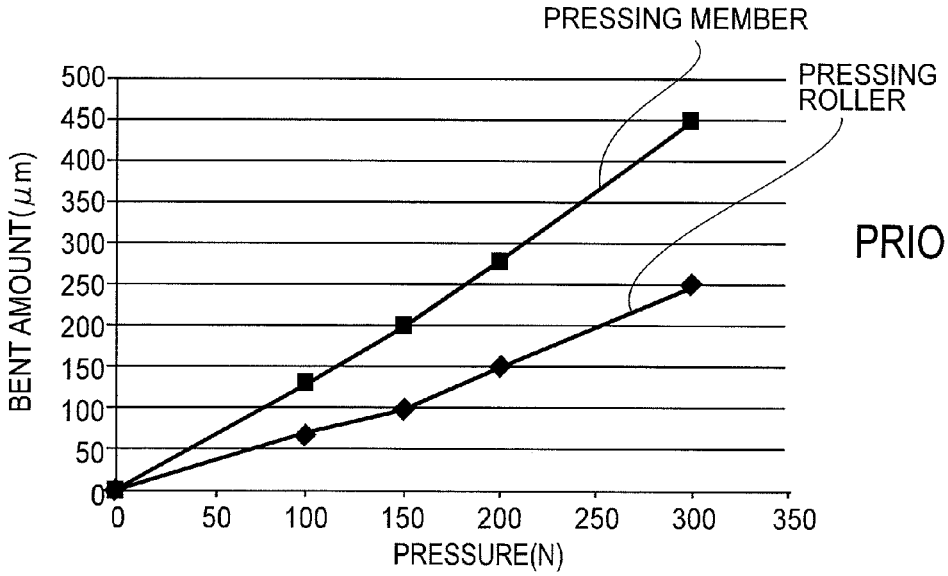
PRIOR ART FIG.6
FIG. 6 is an explanatory view showing a relationship between a curve amount and a pressing force with respect to a pressing member and a shaft member.
Figure 7:
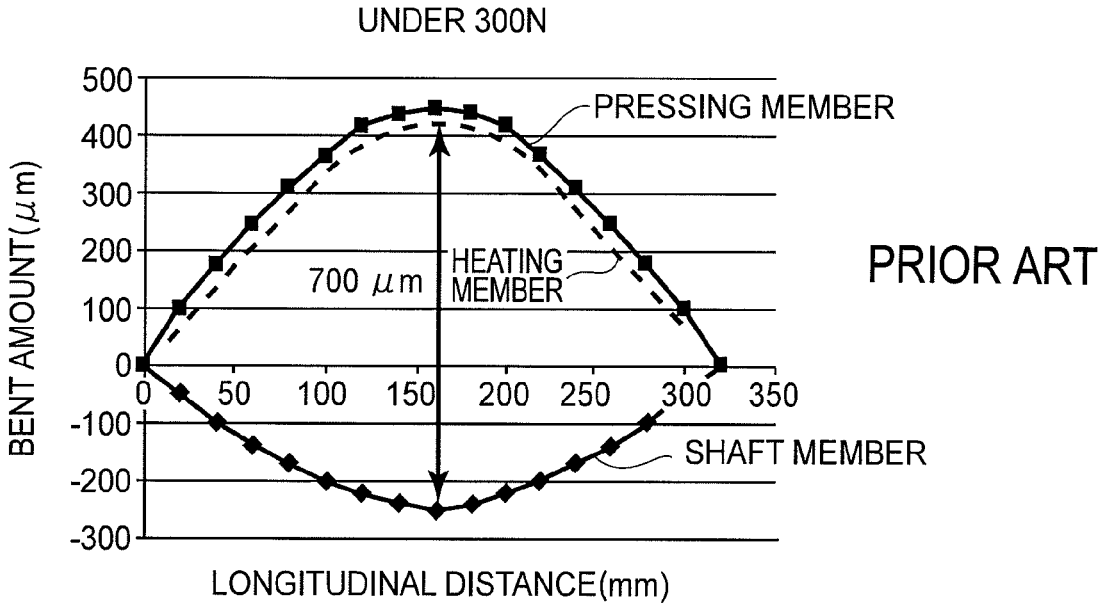
FIG. 7 is an explanatory view of amounts of curve of members in the case where the total pressure of 300N is applied.

FIG. 5 is an explanatory view of a curved state of the respective members in the case where the total pressure of 300 N is applied to the fixing device in Comparative Embodiment 1. FIG. 6 is an explanatory view showing a relationship between a curve amount and the pressing force with respect to the pressing member and the shaft member. FIG. 7 is an explanatory view of the amounts of curve of the respective members in the case where the total pressure of 300N is applied.

As shown in FIG. 5, a fixing device 30A in Comparative Embodiment 1 includes the heating member 4 which has such a shape of outer appearance that a constant thickness with respect to its longitudinal direction and upper and lower surfaces of the heating member 4 are flat. Further, the thickness of the pressing member 5 is smaller with a decreasing weight of the pressing member 5 and the shaft member 3 of the pressing roller 2 is formed of a hollow material, so that the pressing member 5 and the shaft member 3 have larger amounts of curve than those of conventional members. Therefore, the pressing member 5 and the shaft member 3 are liable to cause partial pressure lowering at a central portion in the heating nip with respect to the longitudinal direction by the pressure application.

When the pressing roller 2 is urged upward with a total load (total pressure) of 300N (30 kgf) by being supplied with a pressing force of 150N (15 kgf) at each of the end portions thereof, the pressing roller 2 press-contacts the fixing belt 1 supported at the inner surface by the pressing member 5 and the heating member 4.

At this time, the end portions of the pressing member 5 are curved toward the pressing roller 2 in an arcuate shape and the end portions of the pressing roller 2 are curved toward the pressing member 5, so that the pressure concentrates at end portions Nb of a pressing nip to cause the partial pressure lowering at a central portion Na.

As shown in FIG. 6 with reference to FIG. 5, in the case of the pressing force with the total load of 300N is applied, the pressing member 5 is curved in an amount of 450 μm and the pressing roller 2 is curved in an amount of 250 μm.

As shown in FIG. 5, the end portions of the pressing member 5 are curved downward by 450 μm, thus having a curve amount of +450 μm when the downward direction is plus (+). On the other hand, the end portions of the pressing roller are supplied with an upward load and thus are curved upward, in the arcuate shape opposite from that of the pressing member 5, by 250 μm. Therefore, the curve amount of the pressing roller 2 is −250 μm.

Here, geometrical moment of inertia of the heating member 4 is 200 $mm^4$ and the geometrical moment of inertia of the pressing member 5 is 3000 $mm^4$. Thus, a flexing resistance of the heating member 4 is lower than that of the pressing member, so that the heating member 4 is deformed along the pressing member 5. However, in FIG. 5, for the sake of understanding, the curve amounts of the shaft member 3 and the pressing member 5 are illustrated in an exaggerated manner. On the other hand, the curve of the heating member 4 and the fixing belt 1 is not illustrated.

A distance between the pressing roller 2 and the fixing belt 1 supported by the heating member 4 is 700 μm larger at the central portion than that at the end portions, so that an amount of compression of the elastic layer 7 of the silicone rubber is 700 μm larger at the central portion than that at the end portions. For this reason, a nip pressure is lowered at the central portion with respect to the longitudinal direction to decrease the length of the heating nip with respect to the rotational direction, so that the fixing pressure becomes insufficient or is completely released and thus sufficient heating is not effected with respect to the toner image on the recording material.

Figure 8:
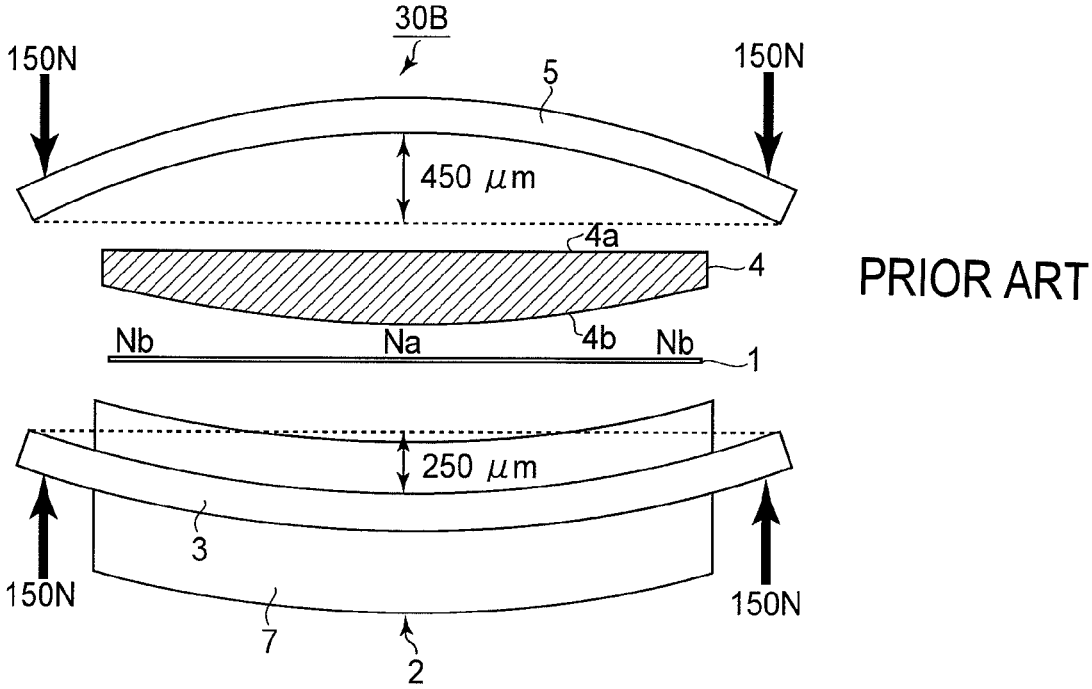
FIG. 8 is an explanatory view of the curved state of the members in the case where the total pressure of 300N is applied to a fixing device in Comparative Embodiment 2.

Therefore, in order to alleviate the partial pressure lowering at the central portion in the heating nip with respect to the longitudinal direction, as shown in FIG. 8, the thickness of the heating member 4 with respect to the pressing direction at the longitudinal central portion of the heating member 4 may only be required to be made larger than that at the end portions by 700 μm so as to cancel the curve amount of 700 μm.

Comparative Embodiment 2

Figure 9:
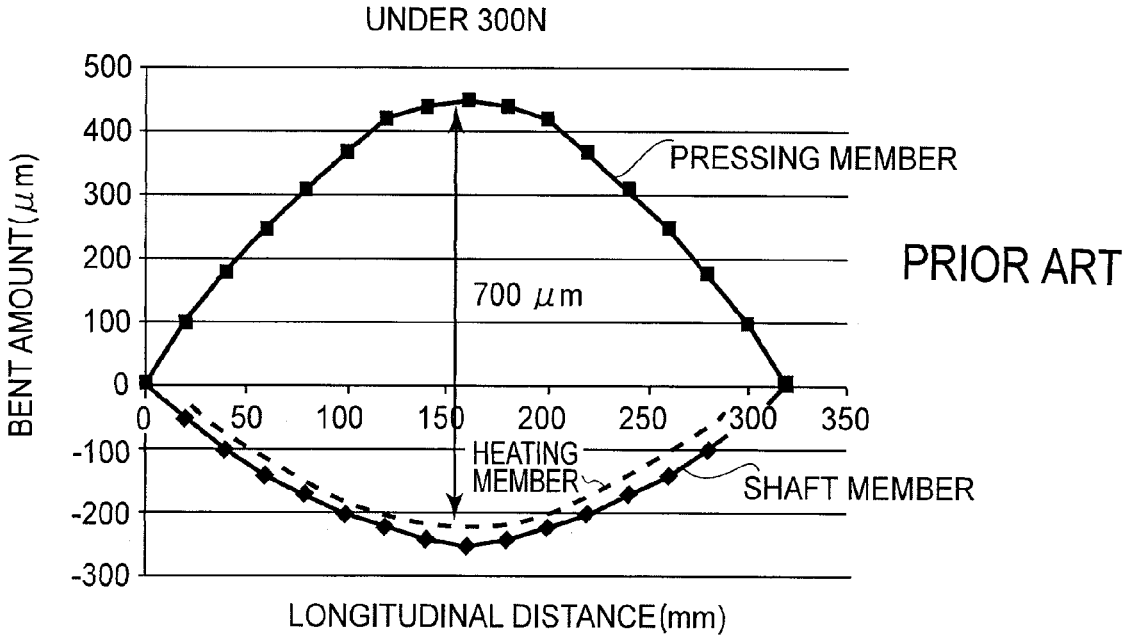
FIG. 9 is an explanatory view of the amounts of curve of the members in the case where the total pressure of 300N is applied.
Figure 10:
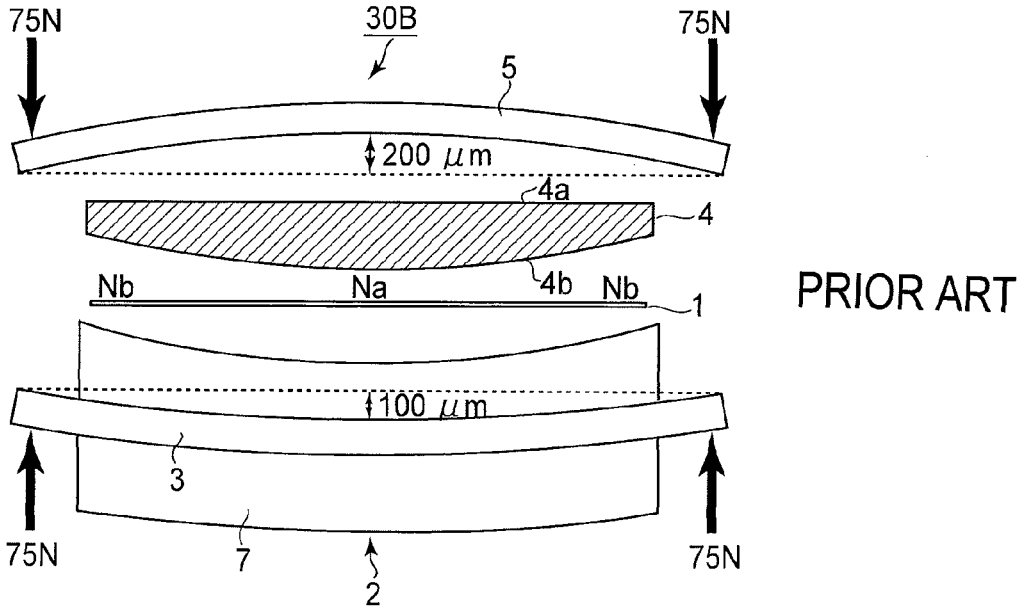
FIG. 10 is an explanatory view of the curved state of the members in the case where the total pressure of 150N is applied to the fixing device in Comparative Embodiment 2.
Figure 11:
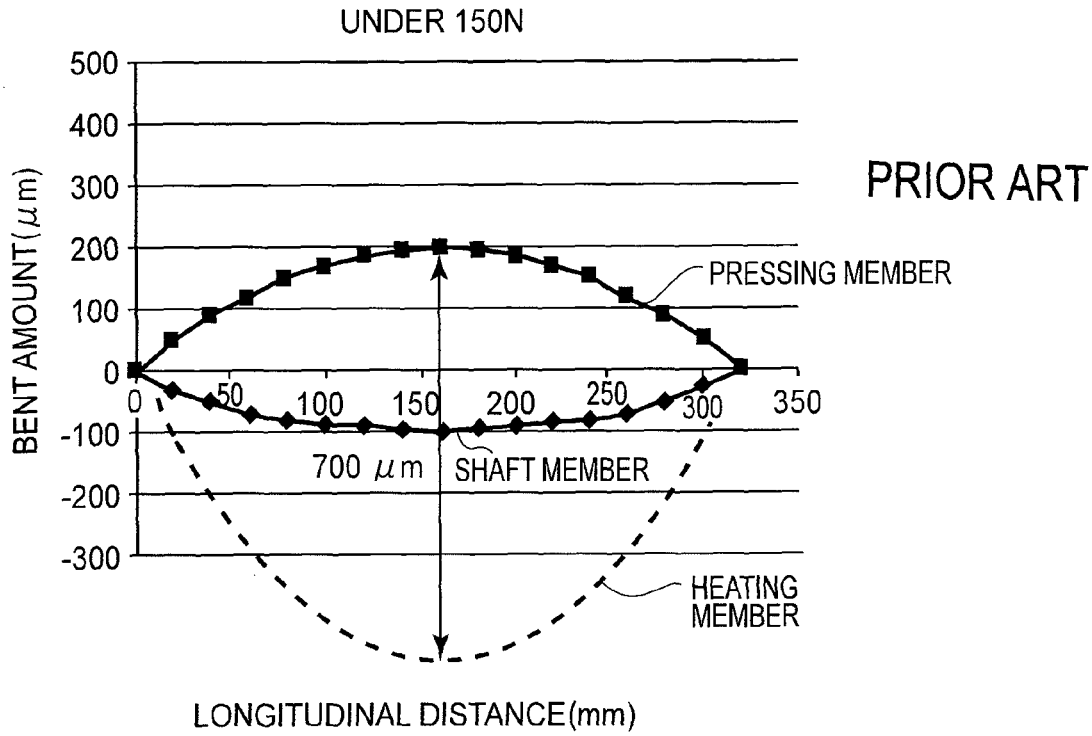
FIG. 11 is an explanatory view of the amounts of curve of the members in the case where the total pressure of 150N is applied.
Figure 12:
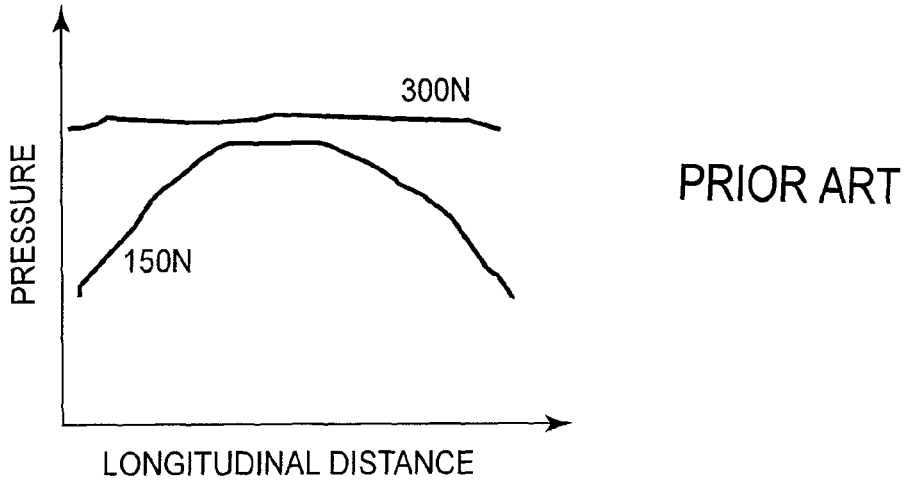
FIG. 12 is an explanatory view showing a change in distribution of nip pressure with respect to a longitudinal direction in the case where the pressing force is switched in Comparative Embodiment 2.

FIG. 8 is an explanatory view of the curved state of the respective members in the case where the total pressure of 300N is applied to a fixing device in Comparative Embodiment 2. FIG. 9 is an explanatory view of the amounts of curve of the respective members in the case where the total pressure of 300N is applied. FIG. 10 is an explanatory view of the curved state of the respective members in the case where the total pressure of 150N is applied to the fixing device in Comparative Embodiment 2. FIG. 11 is an explanatory view of the amounts of curve of the respective members in the case where the total pressure of 150N is applied. FIG. 12 is an explanatory view showing a change in distribution of nip pressure with respect to a longitudinal direction in the case where the pressing force is switched in Comparative Embodiment 2.

As shown in FIG. 8, the heating member 4 of a fixing device 30B in Comparative Embodiment 2 is formed in a downward-convexed arcuate shape at its lower surface, so that the pressing direction thickness of the heating member 8 at the longitudinal central portion is larger than that at the end portions by 700 μm.

As shown in FIG. 9 with reference to FIG. 8, in the case where the pressure with the total pressure of 300N is applied to the fixing device 30B in Comparative Embodiment 2, a total (700 μm) of the curve amounts the pressing member 5 and the shaft member 3 at the longitudinal central portion is cancelled by the increased thickness (700 μm) of the heating member 4 at the longitudinal central portion.

Therefore, the amount of compression of the elastic layer 1 of the pressing roller 2 is substantially equal at both of the central portion Na and the end portions Nb in the heating nip with respect to the longitudinal direction, so that the nip pressure comparable to that at the end portions Nb can also be ensured at the central portion Na to provide a uniform length of the heating nip with respect to the rotational direction. That is, the partial pressure lowering at the central portion Na under pressure with the total pressure of 300N is obviated, so that the rotational direction length of the heating nip at the central portion Na is equal to that at the end portions and the fixing pressure at the central portion Na is also equal to that at the end portions.

However, in the fixing device 30B in Comparative Embodiment 2, when the pressing force is switched from the total pressure of 300N (30 kgf) to the total pressure of 150N (15 kgf), the increased thickness (700 μm) at the longitudinal central portion of the heating member 4 becomes excessive, so that the partial pressure lowering is caused to occur at the end portions.

As shown in FIG. 10, in the case where the pressure with the total pressure of 150N is applied to the fixing device 30B in Comparative Embodiment 2, a total curve amount of the pressing member 5 and the shaft member 3 at the longitudinal central portion is 300 μm which is lower than that in the case of the total pressure of 300N. For this reason, the pressure in the heating nip concentrates at the longitudinal central portion of the heating member 4 at which the thickness is 700 μm larger than that at the longitudinal end portions.

As a result, the pressure is insufficient at the longitudinal central portion of the heating member 4 and the rotational direction length of the heating nip is decreased, so that the fixing pressure is insufficient or completely released and thus sufficient heating cannot be effected with respect to the toner image on the recording material.

As shown in FIG. 10, at the pressing force with the total pressure of 150N, the curve amount of the pressing member 5 is 200 μm and the curve amount of the pressing roller 2 is 100 μm. For this reason, in the case of applying the pressure with the total pressure of 150N, the increased thickness of the heating member 4 at the central portion is required to be 300 μm which is equal to that of the total curve amount of the pressing member 5 and the shaft member 3 at the longitudinal central portion.

FIG. 11 shows the curve amounts of the respective members at the pressing force with the total pressure of 150N in the case where the heating member 4 with the increased thickness of 300 μm at the central portion is employed.

As shown in FIG. 11, when the increased thickness of the heating member 4 at the central portion is 300 μm, as described with reference to FIG. 9, the total curve amount (300 μm) of the pressing member 5 and the shaft member 3 under pressure with the total pressure of 150N is cancelled. The surface of the heating member 4 on the heating nip side is curved along the shaft member 3 with an equal distance (spacing), so that no partial pressure lowering is caused to occur at both of the central portion Na and the end portions Nb.

However, in Comparative Embodiment 2, as shown in FIG. 11 by a broken line, the increased thickness of the heating member 4 at the central portion is 700 μm, so that the central portion of the heating member 4 is excessively curved by 400 μm due to the increased thickness of the heating member 4 at the central portion. The nip pressure concentrates at the central portion Na correspondingly to the excessive curve amount of 400 μm, so that the nip pressure in the heating nip at the end portions Nb is correspondingly lowered. Therefore, at the longitudinal end portions Nb in the heating nip, the partial pressure lowering is caused to occur.

Accordingly, in the constitution in which the curve amounts of the respective members under the pressure application are large as in Comparative Embodiment 2, the curve amounts are changed depending on the pressing force, so that it is very difficult to keep a distribution of the nip pressure in the heating nip with respect to the longitudinal direction at a constant level in a plurality of pressing stages.

As shown in FIG. 12 with reference to FIG. 10, in the case where correction of the thickness distribution of the heating member 4 is made on the basis of the total curve amount of 700 μm with respect to the pressing member 5 and the shaft member 3 at the pressing force of 300N, the partial pressure lowering is caused to occur at the end portions with respect to the longitudinal direction when the pressing force is switched to 150N.

On the other hand, in the case where correction of the thickness distribution of the heating member 4 is made on the basis of the total curve amount of 300 μm with respect to the pressing member 5 and the shaft member 3 at the pressing force of 150N, the partial pressure lowering is caused to occur at the central portion with respect to the longitudinal direction when the pressing force is switched to 300N.

For these reasons, in Comparative Embodiment 2, when the pressing force is switched, the conveying speed of the recording material at the longitudinal central portion in the heating nip is different from that at the longitudinal end portions in the heating nip, so that a conveying property of the recording material is deteriorated. Further, a degree of heat transfer at the central portion is different from that at the end portions, so that local fixing failure is liable to occur.

In the following Embodiment 1, the shape of the heating member and its supporting structure are made different from those in Comparative Embodiment 2, so that the deterioration of the nip pressure distribution in the heating nip with respect to the longitudinal direction when the pressing force is switched.

Embodiment 1

Figure 13:
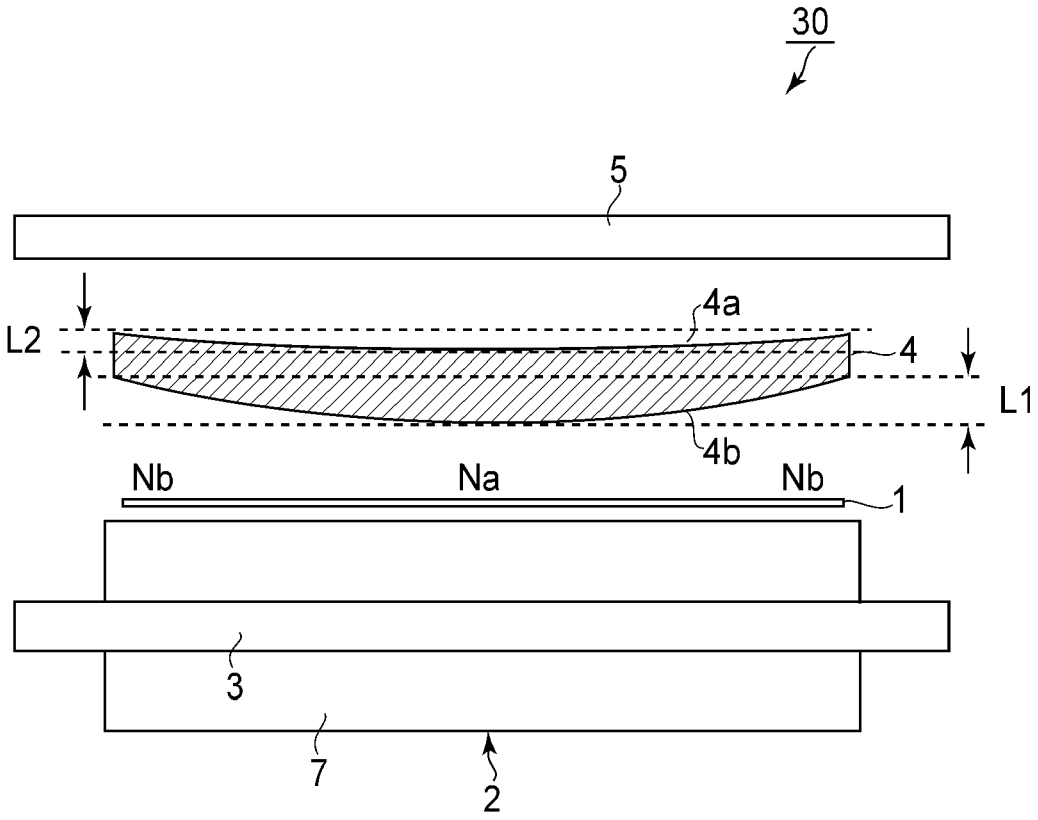
FIG. 13 is an explanatory view of a fixing device in Embodiment 1.
Figure 14:
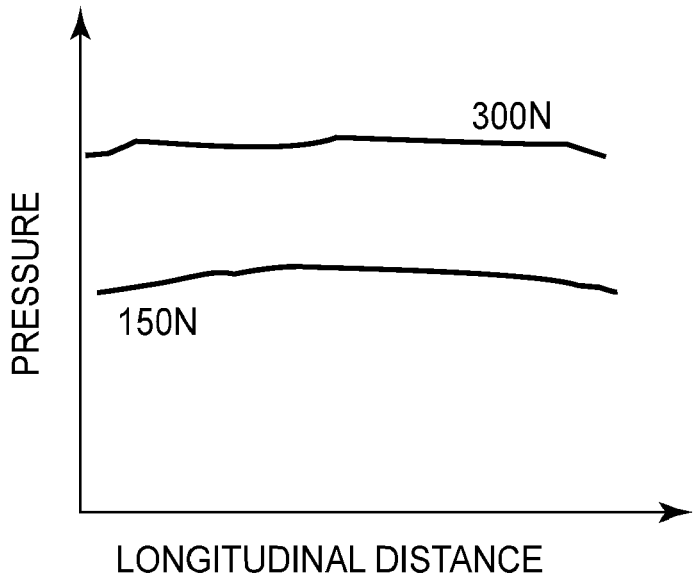
FIG. 14 is an explanatory view showing the change in distribution of nip pressure with respect to the longitudinal direction in the case where the pressing force is switched in Embodiment 1.

FIG. 13 is an explanatory view of a constitution of the fixing device in this embodiment and FIG. 14 is an explanatory view of a change in nip pressure distribution in the case where the pressing force is switched.

As shown in FIG. 13, a fixing device 30 in this embodiment is formed so that the heating member 4 as a pad has an arcuate upper surface and an arcuate lower surface and has the press direction thickness at the longitudinal central portion so as to be 700 μm larger than that at the end portions. Specifically, on the surface of the heating member 4 facing the heating nip, a positive arcuate correction shape is formed, so that the longitudinal central portion is curved downward by L1 (850 μm) on the basis of the end portions. On the other hand, on the surface of the heating member 4 facing the pressing member 5 as the pressing device, a negative arcuate correction shape is formed, so that the central portion is curved downward by L2 (150 μm) on the basis of the end portions.

Incidentally, herein, the "end portions" refer to portions located at both ends with respect to a widthwise direction (longitudinal direction) within a width of the recording material having a maximum size usable in the apparatus. Similarly, the "central portion" refers to a portion located at a center with respect to the widthwise direction (longitudinal direction) within the width of the recording material having the maximum size usable in the apparatus.

As shown in FIG. 7, in the case where the total pressure of 300N is applied, a necessary correction amount at the central portion of the heating member 4 is 700 μm and thus in this embodiment, the correction amount at the central portion of the heating member 4 with the upper and lower correction shapes is set at 700 μm.

In the fixing device 30 in this embodiment in which the heating member 1 having the correction shapes at its upper and lower surfaces was incorporated, the nip pressure distribution in the heating nip with respect to the longitudinal direction was measured by applying the pressure with the total pressure of 300N and with the total pressure of 150N similarly as in Comparative Embodiment 2.

As shown in FIG. 14, in the fixing device 30 in this embodiment, the total pressure was changed from 300N to 150N, the partial pressure lowering at the end portions as shown in FIG. 12 was not caused to occur. At both of the total pressure of 300N and the total pressure of 150N, a good nip pressure distribution with respect to the longitudinal direction was obtained, so that the recording material conveying property and the end portion fixability were sufficiently ensured.

As shown in FIG. 13, under pressure with the total pressure of 300N, the correction amount of 700 μm coincides with the total curve amount (700 μm) of the pressing member 5 and the shaft member 3, so that the nip pressure distribution in the heating nip with respect to the longitudinal direction becomes uniform.

Further, in the case where the total pressure is decreased from 300N to 150N, the heating member 4 is strongly urged toward the pressing roller 2 at the end portions by the pressing member 5 compared with the central portion, so that compared with Comparative Embodiment 2, the nip pressure at the end portions is less liable to lower. On the basis of the constitution in Comparative Embodiment 2, the negative arcuate correction shape was formed at the upper surface of the heating member 4 facing the pressing member 5, so that it was experimentally confirmed that a good nip pressure distribution in the heating nip with respect to the longitudinal direction was obtained both at the total pressure of 300N and at the total pressure of 150N.

Under pressure with the total pressure of 150N, when the negative arcuate correction shape was not formed at the upper surface of the heating member 4, as shown in FIG. 12 in Comparative Embodiment 2, it was experimentally confirmed that the nip pressure in the heating nip with respect to the longitudinal direction was high at the central portion and was low at the end portions.

In this embodiment, in order to increase the nip pressure at the longitudinal end portions under pressure with the total pressure of 150N, the heating member 4 was constituted so that the pressing force from the pressing member 5 was exerted on the heating member 4 in a larger amount at the end portions than at the central portion. In this embodiment, the arcuate correction shape was provided on both of the heating nip side and the pressing member 5 side of the heating member 4, so that the heating member 4 was formed in an outer appearance shape such that it was curved with respect to the pressing direction along the pressing member 5. Further, by employing the constitution of this embodiment, it was experimentally confirmed that compared with Comparative Embodiment 2, the nip pressure distribution in the heating nip with respect to the longitudinal direction was able to be uniformized at the plurality of pressing force levels.

That is, the heating member 4 has a lower rigidity than that of the pressing member 5, so that the heating member 4 is deformed so as to follow spatial deformation of the pressing member 5 with the change in pressing force. Depending on the change in pressing force, a total curved shape caused by the curve of the pressing member 5 and the curve of the shaft member 3 is continuously changed and correspondingly an entering amount of the heating member 4 (the fixing belt 1) with respect to the elastic layer 7 is changed, so that the nip pressure distribution in the heating nip is continuously changed. Then, by adjusting the correction shapes at the upper and lower surfaces of the heating member 4, even when the pressing force is changed, the nip pressure distribution in the heating nip with respect to the longitudinal direction can be optimized so as to be uniform.

In this embodiment, similarly as in Comparative Embodiment 2, the thickness of the heating member 4 at the central portion is made larger than that at the end portions so that the longitudinal nip pressure distribution in the heating nip can be uniform on a maximum pressing force side of the pressing mechanism.

However, in this embodiment, different from Comparative Embodiment 2, the gap is created between the pressing member 5 and the heating member 4 at the longitudinal central portion in a state of no pressure, so that the gap is substantially removed at least in a state in which the heating member 4 is pressed with the maximum pressing force.

For this reason, in a process in which the pressing force is increased from the state in which the gap is present, the heating member 4 having a small flexing resistance is moved in the gap between it and the pressing member 5 to suppress pressure rise at the central portion and on the other hand, only the end portions of the heating member 4 are urged toward the pressing roller 2. For this reason, compared with the constitution of Comparative Embodiment 2 in which there is no gap at the longitudinal central portion between the pressing member 5 and the heating member 4, the pressing force distribution at the central portion is decreased and on the other hand, the pressing force distribution at the end portions is increased.

Therefore, in this embodiment, the longitudinal nip pressure distribution in the heating nip under pressure with the total pressure of 300N is uniform and the nip pressure at the end portions is no lowered under pressure with the total pressure of 150N.

In this embodiment, the elastic flexing resistance of the heating member 4 is smaller than that of the shaft member 3, and the elastic flexing resistance in a state in which the pressing member 5 and the heating member 4 are superposed is larger than that of the shaft member 3.

For this reason, the heating nip is moved toward the pressing member 5 side until the gap on the rear (upper) surface of the heating member 4 is removed by the increase in pressing force but after the rear surface of the heating member 4 hermetically contacts the pressing member 5, the heating nip is pushed back to the pressing roller 2 side.

Accordingly, compared with Comparative Embodiment 2 in which the heating nip is one-sidedly moved continuously toward the pressing member side with the increase in pressing force, in this embodiment, the change in curved shape under pressure with the total pressure of 300N and under pressure with the total pressure of 150N is small, so that a degree of non-uniformity of the conveying property is small.

From the above-described experimental result, even when the different pressing forces are set with respect to the fixing device having the large curve amount under pressure application, the longitudinal nip pressure distribution in the heating nip can be kept uniform. In combination of two conditions such that the heating member 4 is thick at the central portion and that the heating member 4 is curved with respect to the longitudinal direction, even when the pressure in the heating nip is switched, the pressure in the heating nip with respect to the rotational axis direction is close to a uniform level.

The above-described numerical values are optimized through the experiment and thus optimum values vary depending on the constitution of the fixing device employed and are not determined uniquely.

As described above, according to the constitution of this embodiment, when the pressing force is lowered, the pressing force acts on the end portions of the pressing member 5 in a larger amount than that in the case of Comparative Embodiment 2, so that the nip pressure is not lowered to the degree of that in Comparative Embodiment 2.

For this reason, even when the different pressing forces are set with respect to the fixing device 30 in which the shaft member 3 and the pressing member 5 are considerably curved under pressure application, the nip pressure distribution in the heating nip with respect to the longitudinal direction can be kept uniform. As a result, it is possible to prevent deteriorations of the fixability and the conveying property due to non-uniformity of the nip pressure distribution in the heating nip with respect to the longitudinal direction.

In other words, in the process in which the pressing force is decreased by the pressure changing means, the entire pressing force in the heating nip is decreased in a state in which the end portions of the heating member 4 are strongly pressed toward the nip-forming member by the pressing member compared with the case of the central portion. For this reason, excessive pressure lowering at the longitudinal end portions in the heating nip when the pressing force is lowered is suppressed.

Further, in the process in which the pressing force is increased by the pressure changing means, the central portion of the heating member is moved toward the curved gap side to suppress the pressure rise at the central portion and on the other hand, the end portions of the heating member are pressed toward the nip-forming member side. For this reason, compared with the central portion, the pressing force distributed to the end portions is increased.

Therefore, when the pressing force in the heating nip is changed, partial pressure lowering in the heating nip with respect to the longitudinal direction is less liable to occur.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 027784/2009 filed Feb. 9, 2009, which is hereby incorporated by reference.

What is claimed is:

1. An image bearing heating apparatus comprising:

a belt;

an opposing roller, disposed opposed to said belt, and configured to form the nip between said belt and itself;

a pad, disposed so as to sandwich said belt between said opposing roller and itself, and configured to press said belt toward said opposing roller in the nip;

a pressure device configured and positioned to press at least one of said pad and said opposing roller so that said belt is pressed between said pad and said opposing roller in the nip; and a pressure changing device configured and positioned to change a pressure in the nip by said pressing device;

wherein said pad has a thickness, at its longitudinal central portion, larger than that at its longitudinal end portions, wherein said pad has a first surface on said belt side and a second surface opposite from the first surface, and wherein each of the first surface and the second surface opposite from the first surface is curved longitudinally toward said opposing roller so that the longitudinal central portion of said pad is closer to said opposing roller than the longitudinal end portions of said pad.

2. An image heating apparatus according to claim 1, wherein said pressing device includes a holder configured and positioned to hold said pad along the longitudinal direction and includes first and second contacting members at longitudinal end portions of said holder to sandwich said belt between said pad and said opposing roller in the nip, wherein said opposing roller has a shaft which is supported at the longitudinal end portions by said image heating apparatus.

3. An image heating apparatus according to claim 1, wherein said pad has a geometrical moment of inertia smaller than that of said holder's geometrical moment of inertia.

4. An image heating apparatus according to claim 1, wherein said pad includes a heat generating element to heat said belt.

5. An image heating apparatus according to claim 1, wherein said opposing roller applies a rotational force to said belt in the nip to drive said belt.

* * * * *